US006742283B2

(12) United States Patent
Ishii

(10) Patent No.: US 6,742,283 B2
(45) Date of Patent: Jun. 1, 2004

(54) WOOD DRYING METHOD

(75) Inventor: Sachio Ishii, Maebashi (JP)

(73) Assignee: Technical System Keep Limited Company, Tokyo (JP)

( * ) Notice: Subject to any disclaimer, the term of this patent is extended or adjusted under 35 U.S.C. 154(b) by 0 days.

(21) Appl. No.: 10/220,975

(22) PCT Filed: Mar. 1, 2001

(86) PCT No.: PCT/JP01/01549

§ 371 (c)(1),
(2), (4) Date: Oct. 21, 2002

(87) PCT Pub. No.: WO01/66322

PCT Pub. Date: Sep. 13, 2001

(65) Prior Publication Data

US 2003/0115771 A1 Jun. 26, 2003

(30) Foreign Application Priority Data

Mar. 6, 2000 (JP) ..... 2000-060344

(51) Int. Cl.[7] ..... F26B 3/00

(52) U.S. Cl. ..... 34/479; 34/417; 34/478; 34/513

(58) Field of Search ..... 34/413, 417, 478, 34/479, 513, 518

(56) References Cited

U.S. PATENT DOCUMENTS 4,233,753 A * 11/1980 Olson ..... 34/405
4,343,095 A * 8/1982 Rosen et al. ..... 34/411
4,345,384 A * 8/1982 Pagnozzi et al. ..... 34/411
5,392,530 A * 2/1995 Izumi ..... 34/404
5,852,880 A * 12/1998 Harrison ..... 34/92

FOREIGN PATENT DOCUMENTS

JP 06213568 A * 8/1994
JP 08210772 A * 8/1996

* cited by examiner

*Primary Examiner*—Ira S. Lazarus
*Assistant Examiner*—Kathryn S. O'Malley
(74) *Attorney, Agent, or Firm*—Jordan and Hamburg LLP

(57) ABSTRACT

Method for drying wood in a short period of time by maintaining the concentration of a combustion gas contained in a drying room atmosphere for use in drying the wood to a high value and by maintaining the pressure of the drying room atmosphere to a high value. Wood fuels such as waste wood are put into a combustion chamber ins lower area of a combustion gas generating furnace and then the wood fuels are burned, followed by introducing the high-temperature combustion gas generated by the burning of the wood fuels into an upper area of a drying room housing the green wood to thereby dry the wood. Thermal drying of the wood is carried out by maintaining the concentration of the combustion gas present in the drying room atmosphere at a the high value and by maintaining the pressure of the drying room atmosphere at a high value.

11 Claims, 2 Drawing Sheets

WOOD DRYING METHOD

BACKGROUND OF THE INVENTION

1. Field of the Invention

The present invention relates to a method for drying wood, and more particularly to a method for drying green wood such as thinnings, green bamboo or similar other green plants in a short period of time. In the present specification, the term "wood" includes the bamboo and other green plants.

2. Description of the Prior Art

Conventionally, there are proposed various methods for drying wood including a method in which green wood is put in a drying room to be sealed, and wood fuels such as waste wood are put into a combustion chamber provided in a lower area of a combustion gas generating furnace to be sealed and then the wood fuels are burned, followed by introducing a high-temperature combustion gas generated by the burning into an upper area of the drying room, to thereby dry the wood, wherein the concentration of the oxygen in the drying room is maintained to a low level.

According to the above-mentioned conventional method for drying wood, the wood can be dried safely and uniformly by maintaining the concentration of the oxygen in the drying room, i.e. the oxygen content in the combustion gas, to such a low level as being almost equal to zero. However, the above conventional method for drying wood by controlling the concentration of the oxygen is insufficient to efficiently dry the wood in a short period of time and is required to be further improved.

SUMMARY OF THE INVENTION

It is therefore an object of the present invention to provide a method for drying wood which is capable of efficiently drying the wood in a shorter period of time, by maintaining the concentration of the combustion gas for use in drying the wood to a high value and by maintaining the pressure of the drying room atmosphere containing the combustion gas to a high value.

To attain the object, the present invention provides a method for drying wood comprising the steps of putting wood fuels such as waste wood into a combustion chamber provided in a lower area of a combustion gas generating furnace, burning the same, and introducing a high-temperature combustion gas generated by the burning into an upper area of a drying room housing green wood, to thereby thermally dry said wood by said combustion gas, wherein the thermal drying of said wood is carried out by maintaining concentration of said combustion gas contained in said drying room atmosphere existing in said drying wood to a high value. The method is further characterized in that the maintenance of the concentration of said combustion gas is carried out by controlling the discharge amount of the drying room atmosphere discharged from the chimney and the introduction amount of the combustion gas introduced into the drying room. The method is furthermore characterized in that the maintenance of the concentration of said combustion gas is carried out by controlling the recovery amount of the drying room atmosphere recovered from the drying room into the combustion chamber and the introduction amount of the combustion gas introduced into the drying room. The method is furthermore characterized in that the concentration of said combustion gas is maintained to a high concentration in the range of 60 to 95 (volume) %. The method is furthermore characterized in that the pressure of a drying room atmosphere is maintained to a high value by hermetically sealing said drying room. The method is furthermore characterized in that said pressure of a drying room atmosphere is maintained to a high pressure in the range of 1.5 to 5 atmospheric pressure. The method is furthermore characterized in that the superheated steam is generated in said combustion gas generating furnace and introduced into the drying room together with the combustion gas.

BRIEF DESCRIPTION OF THE DRAWINGS

These and other objects and advantages of the present invention will become clear from the following description with reference to the accompanying drawings, wherein.

DETAILED DESCRIPTION OF THE INVENTION (PREFERRED EMBODIMENTS)

The present invention will now be described in detail with reference to the drawings showing an embodiment thereof.

Figure 1:
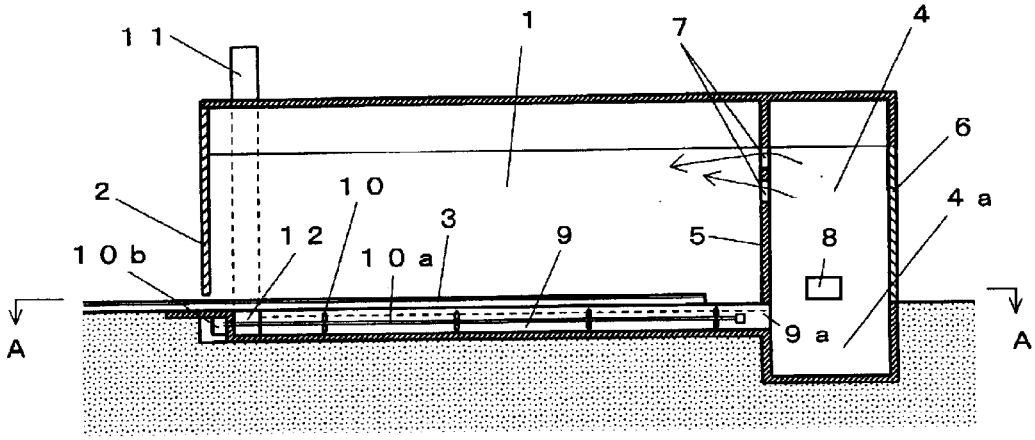
FIG. 1 is a sectional side view showing the construction of an apparatus for carrying out an embodiment of the method for drying wood according to the present invention.
Figure 2:
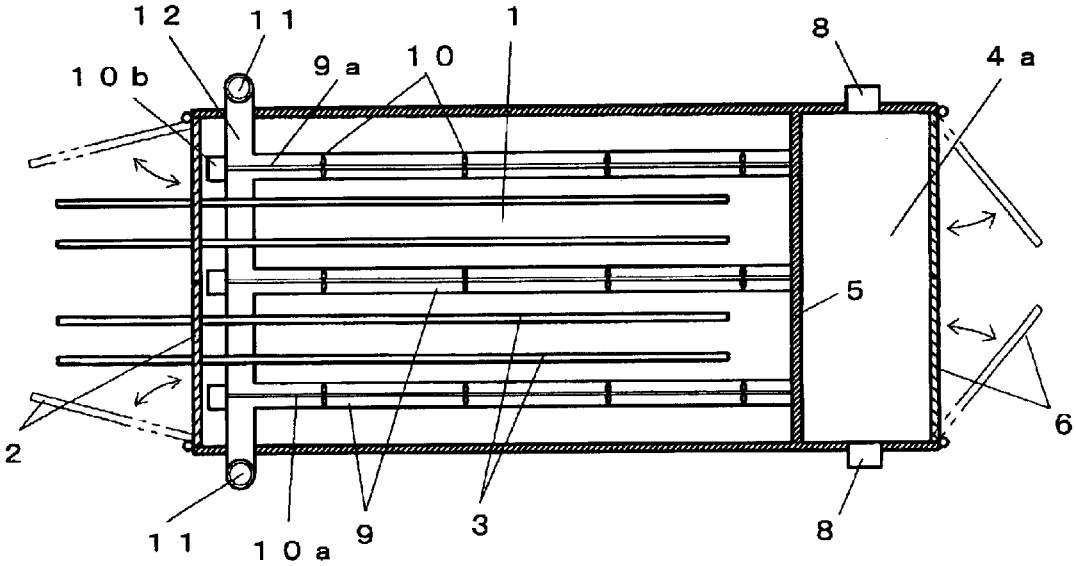
FIG. 2 is a sectional plan view showing the construction of the apparatus taken along a line A—A.

In FIGS. 1 and 2, reference numeral 1 designates a drying room which houses green wood such as thinnings. Reference numeral 2 designates each of opening and closing doors which opens when the wood is put into and taken out from the drying room 1. Reference numeral 3 designates each of rails which is laid on a floor of the drying room 1 and extends to the outside from an entrance for wood, at which the opening and closing doors 2 are provided. The interior of the drying room 1 can be hermetically sealed when the opening and closing doors 2 are closed. A truck (not shown) travels on the rails 3, and the truck mounts thereon the wood. In this connection, the rails 3 and the truck are just examples of means for putting and taking out the wood into and from the drying room 1, and therefore the means are not confined to these examples.

Reference numeral 4 designates a combustion gas generating furnace disposed so as to be adjacent to the drying room 1 with a bulkhead 5 partitioning therebetween. The combustion gas generating furnace 4 has a combustion chamber 4*a* at a lower area thereof. The combustion gas generating furnace 4 has opening and closing doors 6 which opens when wood fuels such as waste wood are put into the combustion chamber 4*a* or ashes are discharged. The opening and closing doors 6 are closed to hermetically seal the interior of the combustion gas generating furnace 4 during combustion.

The bulkhead 5 has combustion gas supplying passages 7 formed therein at upper locations thereof, for introducing the high-temperature combustion gas generated in the combustion gas generating furnace 4 into an upper area of the drying room 1. Each combustion gas supplying passage 7 may be provided with a flow rate regulating plate (not shown) such as a damper, for regulating the flow rate of the combustion gas introduced into the drying room 1 to the range of 0 to 100%. It is preferable that the combustion gas is introduced into the drying room 1 before the temperature thereof falls, and therefore the combustion gas generating furnace 4 is preferably disposed so as to be adjacent to the drying room 1, but this is not defined to the above. Alternatively, the combustion gas generating furnace 4 and the drying room 1 may be disposed at separate locations from each other.

Reference numeral 8 designates each of fresh air inlet ports which opens on the periphery of the combustion chamber 4*a* at a suitable location thereof, for supplying fresh air into the combustion chamber 4*a*. The fresh air inlet port 8 is provided with a fan and a damper (not shown). The provision thereof enables to positively and stably supply fresh air even if the pressure of the combustion gas within the combustion chamber 4*a* is high, and to regulate the amount of fresh air to be supplied.

Reference numeral 9 designates each of atmosphere recovery conduits which is formed in a bottom of the drying room 1. The atmosphere recovery conduit 9 is formed like a channel which has its upper portion opened to the drying room 1 and has its exhaust port 9*a* opened to the combustion chamber 4*a*. The atmosphere recovery conduit 9 has a plurality of fans 10 arranged therein, each of which positively and stably supplies the drying room atmosphere which is a portion of the mixture of the combustion gas introduced to the drying room 1 and moisture and volatile materials evaporating from the wood (the moisture and the volatile materials will be generically referred to as "the wood evaporative gases") into the combustion chamber 4*a*, and controls the recovery amount of the atmosphere. The plurality of fans 10 are arranged along the atmosphere recovery conduits 9. The fans 10 are each fixed to a rotary shaft 10*a* to be rotated by means of rotation driving means 10*b* such as an electric motor. It is preferable that a covering plate (not shown) such as an iron plate is partially laid on the upper opening portion of the atmosphere recovery conduit 9 at the location where the fans 10 are placed, so that the efficiency of blowing by means of the fans 10 is improved. Further, the other opening portions of the respective atmosphere recovery conduits 9 are preferably covered with air-permeable covers (not shown), such as meshes or porous plates. The atmosphere recovery conduit 9 is not limitative to the channel structure mentioned above, but it may be formed like a cylindrical recovery conduit which communicates with the drying room 1 at suitable communicating holes. In this case, the fan 10 may be arranged in the communicating hole. The atmosphere recovery conduit 9 may includes a damper (not shown), together with or in place of the fan 10, to thereby control the recovery amount of the atmosphere within the drying room 1.

Reference numeral 11 designates a chimney which discharges, into the atmospheric air, part of the low-temperature drying room atmosphere, which has fallen to the bottom of the drying room 1. An intake port formed at a lower end of the chimney 11 communicates with an atmosphere discharging conduit 12 formed on the bottom of the drying room 1. The intake port may includes a damper or a fan to thereby control the amount of the discharge gas. It is preferable that the atmosphere discharging conduit 12 is formed on the bottom at a location most separate from the combustion gas supplying passage 7. In the present embodiment, the atmosphere discharging conduit 12 communicates with the atmosphere recovery conduit 9, but this is not defined to the above. Alternatively, they may be separately formed without communication therebetween. Further, the atmosphere discharging conduit 12 may be dispensed with. In other words, the intake port formed at the lower end of the chimney 11 is only required to be arranged on the bottom of the drying room 1 and at the location separate from the combustion gas supplying passage 7.

Next, description will be made of a method for drying wood by using the above described wood drying apparatus of the present embodiment.

First, the green wood, such as thinnings, to be dried is piled up on the truck (not shown), and then the truck is allowed to travel on the rails 3, to thereby houses the wood in the drying room 1. When housing of the wood is completed, the opening doors 2 are closed to hermetically seal the drying room 1. On the other hand, wood fuels such as waste wood are put into the combustion chamber 4*a*, and the opening and closing doors 6 are closed, followed by igniting and burning the fuels, to thereby generate a combustion gas.

The high-temperature combustion gas generated in the combustion gas generating furnace 4 is introduced through the combustion gas supplying passages 7 into the upper area of the drying room 1. According to the introduction of the combustion gas, air in the drying room 1 is discharged through the chimney 11 into the atmospheric air, or fed through the atmosphere recovery conduits 9 into the combustion chamber 4*a*, and then it is consumed as burning air. In this manner, the air which has been present in the drying room 1 is replaced by the introduced combustion gas, and therefore the interior of the drying room 1 is filled with the combustion gas, whereby the interior of the drying room 1 assumes a high temperature due to the presence of the combustion gas.

The high-temperature combustion gas passes through the wood piled up in the drying room 1, whereby the wood is subjected to a thermal dry treatment. The thus thermally dried wood allows its moisture contained therein to evaporate therefrom and also allows wood evaporative gases such as volatile materials to evaporate therefrom. The combustion gas are mixed with the wood evaporative gases to turn into the drying room atmosphere, whereby the interior of the drying room 1 is filled with the drying room atmosphere. Due to the mixture of the combustion gas with the wood evaporative gases, the temperature of the drying room atmosphere is lowered, whereby the atmosphere is rendered heavy and falls on the bottom of the drying room 1.

Part of the drying room atmosphere which has become heavy due to the low temperature passes through the atmosphere discharging conduit 12 and is discharged from the chimney 11 into the atmospheric air. Part of the drying room atmosphere is recovered through the atmosphere recovery conduits 9 into the combustion chamber 4*a*. When the discharge amount of the drying room atmosphere discharged from the chimney 11 is controlled, the combustion gas is introduced into the drying room 1 from the combustion gas generating furnace 4, depending on the discharge amount of the drying room atmosphere. The fresh air is supplied into the combustion chamber 4*a* from the fresh air inlet ports 8, and therefore the combustion becomes active. Then, a large amount of the combustion gas is introduced into the drying room 1, whereby the concentration of the combustion gas in the drying room 1 becomes high. On the other hand, when the recovery amount of the drying room atmosphere which is recovered from the drying room 1 to the combustion chamber 4*a* is increased and hence the oxygen amount in the combustion chamber 4*a* falls short, the combustion speed is rendered slow, which suppresses generation of the combustion gas, whereby the concentration of the combustion gas in the drying room 1 becomes low. In this manner, by controlling the discharge amount of the combustion gas from the chimney 11 or the recovery amount of the same from the atmosphere recovery conduit 9, the concentration of the combustion gas in the drying room atmosphere in the drying room 1 can be maintained to a high concentration, for example, in the range of 60 to 95 (volume) %.

Further, since the interior of the drying room 1 is hermetically sealed, the obligatory introduction of the combustion gas leads to an increase in pressure within the drying room 1, resulting in further acceleration of the thermal drying treatment. By closing the combustion gas supplying passages 7 by means of the flow rate regulating plate, the interior of the drying room 1 can be maintained to a high pressure in the range of 1.5 to 5 atmospheric pressure. Further, by sealing the interior of the combustion gas generating furnace 4 by closing the fresh air inlet port 8, or by forcing a fresh air to introduce into the furnace 4 by means of a fan (not shown) arranged in the fresh air inlet port 8, the interior of the drying room 1 can be maintained to the high pressure as above.

Fresh air supplied into the combustion chamber 4*a* is thus controlled with respect to its inflow amount, and almost 100% of the supplied air is consumed for combustion. As a result, the combustion gas flowing into the drying room 1 contain almost without oxygen. Accordingly, by the high temperature combustion gas in the drying room 1, there is no fear of ignition of the wood in the drying room 1 and therefore a fire accident.

The volatile materials generated from the wood during the drying treatment are not only decomposed by heat in the drying room 1, but are also recovered to the combustion chamber 4*a* for the most part together with the combustion gas, and then decomposed and burned. As a result, environmental pollution due to gases discharged from the chimney 11 into the air can be drastically mitigated.

In addition, the combustion gas generating furnace 4 may have a vapor generator, not shown, provided therein, which is formed by an iron grid etc. In this provision, a water supply port may be provided directly above the generator, and water is dropped and supplied to the vapor generator which is heated by the combustion, to thereby generate superheated steam. The thus generated superheated steam is introduced into the drying room 1 together with the combustion gas, to thereby prevent a peripheral portion of the wood to be dried from being excessively dried and hardened. As a result, the wood can have its peripheral portion and its core portion uniformly dried.

While there has been described what are at present considered to be a preferred embodiment of the invention, it will be understood that various modifications may be made thereto, and it is intended that the appended claims cover all such modifications as fall within the true spirit and scope of the invention. Since the concentration of the combustion gas for use in drying the wood is maintained to the high value and the pressure of the drying room atmosphere containing the combustion gas is maintained to the high value, the wood can be efficiently dried in a short period of time.

What is claimed is:

1. A method for drying wood comprising the steps of:

putting fuel into a combustion chamber arranged in a lower area of a combustion gas generating furnace;

burning the fuel to generate a high-temperature combustion gas in the furnace;

introducing the combustion gas generated by the burning of the fuel in the furnace into an upper area of a drying room housing wood to be dried to thereby thermally dry the wood;

controlling a discharge of a drying room atmosphere including air and combustion gas from the drying room through a chimney;

controlling the introduction of the combustion gas generated in the furnace into the drying room based on the discharge of the drying room atmosphere through the chimney; and controlling a recovery flow of air and combustion gas from the drying room into the furnace, the discharge of the drying room atmosphere, the introduction of the combustion gas into the drying room and the recovery flow of air and combustion gas into the furnace being controlled to maintain a concentration of combustion gas in the drying room in a range of 60% to 95% by volume and the pressure of the drying room atmosphere in a range of 1.5 to 5 atmospheres.

2. A method for drying wood as claimed in claim 1, further comprising the step of hermetically sealing said the drying room to aid in maintaining the pressure of the drying room in the range of 1.5 to 5 atmospheres.

3. A method for drying wood as claimed in claim 1, further comprising the steps of:

generating superheated steam in the combustion gas generating furnace; and introducing the superheated steam into the drying room together with the combustion gas.

4. A method for drying wood as claimed in claim 3, wherein the step of introducing the superheated steam into the drying room together with the combustion gas comprises the step of passing the combustion gas and superheated steam through a common combustion gas supply passage from the furnace to the drying room.

5. A method for drying wood as claimed in claim 1, further comprising the steps of:

supplying fresh air into the furnace; and regulating the amount of fresh air being supplied to the furnace.

6. A method for drying wood as claimed in claim 5, further comprising the steps of:

passing the fresh air through a fresh air inlet port; and closing the fresh air inlet port to thereby seal an interior of the furnace and aid in maintaining the pressure of the drying room in the range of 1.5 to 5 atmospheres.

7. A method for drying wood as claimed in claim 1, wherein the step of controlling the recovery flow of air and combustion gas from the drying room into the furnace comprises the steps of arranging in a bottom of the drying room at least one recovery conduit which leads to the furnace and arranging fans in the at least one recovery conduit.

8. A method for drying wood as claimed in claim 1, wherein the step of controlling the discharge of the drying room atmosphere from the drying room through the chimney comprises the steps of forming an intake port at a lower end of the chimney and arranging a damper or fan in the intake port.

9. A method for drying wood as claimed in claim 8, further comprising the steps of:

forming a discharge conduit on a bottom of the drying room at a location most distant from a combustion gas supply passage through which the combustion gas is introduced into the drying room; and coupling the discharge conduit to the intake port.

10. A method for drying wood as claimed in claim 1, wherein the step of controlling the introduction of the combustion gas into the drying room comprises the steps of arranging a flow rate regulating plate in a combustion gas supply passage leading from the furnace to the drying room and closing the flow rate regulating plate to aid in maintaining the pressure in the drying room in the range of 1.5 to 5 atmospheres.

11. A method for drying wood as claimed in claim 1, wherein the fuel is waste wood.

* * * * *